US006457552B2

(12) United States Patent
Maganas et al.

(10) Patent No.: US 6,457,552 B2
(45) Date of Patent: Oct. 1, 2002

(54) METHODS AND APPARATUS FOR LOW BACK PRESSURE MUFFLING OF INTERNAL COMBUSTION ENGINES

(76) Inventors: Thomas C. Maganas, 1200 Ardmore, Manhattan Beach, CA (US) 90266; Alan L. Harrington, 425 Cirby Way #63, Roseville, CA (US) 95678

( * ) Notice: Subject to any disclaimer, the term of this patent is extended or adjusted under 35 U.S.C. 154(b) by 0 days.

(21) Appl. No.: 09/778,418

(22) Filed: Feb. 7, 2001

Related U.S. Application Data

(60) Provisional application No. 60/183,088, filed on Feb. 15, 2000.

(51) Int. Cl.[7] ..... F01N 1/24

(52) U.S. Cl. ..... 181/258; 181/238; 181/248; 181/249; 181/250; 181/251; 181/268

(58) Field of Search ..... 181/258, 251, 181/238, 248, 249, 250, 268, 211

(56) References Cited

U.S. PATENT DOCUMENTS

| | | | | |
|---|---|---|---|---|
| 2,956,865 A | | 10/1960 | Williams | 23/284 |
| 3,632,304 A | | 1/1972 | Hardison | 23/2 |
| 3,714,071 A | | 1/1973 | Michalko | 252/448 |
| 3,841,242 A | | 10/1974 | Sigg | 110/8 |
| 3,915,890 A | | 10/1975 | Soldate | 252/411 |
| 3,922,975 A | | 12/1975 | Reese | 110/8 |
| 4,052,173 A | | 10/1977 | Schultz | 48/202 |
| 4,308,806 A | | 1/1982 | Uemura et al. | 110/244 |
| 4,330,513 A | | 5/1982 | Hunter et al. | 423/245 |
| 4,497,637 A | | 2/1985 | Purdy et al. | 48/111 |
| 4,623,400 A | | 11/1986 | Japka et al. | 148/6.35 |
| 4,701,312 A | | 10/1987 | Kice | 423/213.7 |
| 4,708,067 A | | 11/1987 | Narisoko et al. | 110/245 |
| 4,724,776 A | | 2/1988 | Foresto | 110/235 |
| 4,761,270 A | | 8/1988 | Turchan | 423/235 |
| 4,809,812 A | * | 3/1989 | Flugger | 181/268 |
| 4,818,511 A | | 4/1989 | Nishi et al. | 423/344 |
| 4,886,001 A | | 12/1989 | Chang et al. | 110/346 |
| 4,923,033 A | * | 5/1990 | Panick et al. | 181/211 |
| 4,974,531 A | | 12/1990 | Korenberg | 110/245 |
| 4,977,840 A | | 12/1990 | Summers | 110/346 |
| 4,991,521 A | | 2/1991 | Green et al. | 110/347 |
| 5,010,830 A | | 4/1991 | Asuka et al. | 110/347 |
| 5,178,101 A | | 1/1993 | Bell | 122/4 |

(List continued on next page.)

FOREIGN PATENT DOCUMENTS

| | | | |
|---|---|---|---|
| EP | 0 176 123 A1 | 4/1986 | 23/7 |
| EP | 0 605 719 A1 | 7/1994 | 53/36 |
| FR | 2 687 765 A1 | 8/1993 | |
| FR | 2 701 223 A1 | 8/1994 | |
| GB | 541962 | 12/1941 | |

OTHER PUBLICATIONS

Agarwal, Kedar, *Pyrolysis of Polymer Waste*, pp. 232–245, Society of Plastic Engineers, "Plastics Recycling: Technology Charts the Course," (Nov. 4, 1994).

(List continued on next page.)

*Primary Examiner*—Shih-Yung Hsieh
(74) *Attorney, Agent, or Firm*—Workman, Nydegger & Seeley

(57) ABSTRACT

Systems and apparatus for muffling sounds produced by an internal combustion engine, and optionally catalytically degrading pollutants within waste exhaust gases. The systems and apparatus utilize a bed of particles within a muffling chamber. The gases are introduced using a diffusion tube with holes therethrough. The muffling particles preferably include silica or alumina, which can also catalytically degrade pollutants. Typically, the muffling/reaction chamber is maintained at a temperature in a range from about 50° C. to about 500° C., which is much lower than temperatures within conventional muffling systems for diesel engines. The muffling systems operate as substantially lower back pressure compared to conventional muffling systems. The systems and apparatus can be adapted to be used in combination with diesel engines or other internal combustion engines and industrial burners.

17 Claims, 4 Drawing Sheets

U.S. PATENT DOCUMENTS

| | | | | | |
|---|---|---|---|---|---|
| 5,181,795 | A | | 1/1993 | Circeo, Jr. et al. | 405/128 |
| 5,207,734 | A | * | 5/1993 | Day et al. | 60/278 |
| 5,335,609 | A | | 8/1994 | Nelson et al. | 110/346 |
| 5,347,936 | A | | 9/1994 | Thorhuus | 110/260 |
| 5,370,854 | A | | 12/1994 | Henley et al. | 423/409 |
| 5,662,875 | A | | 9/1997 | Bachelard et al. | 423/344 |
| 5,676,070 | A | | 10/1997 | Maganas et al. | 110/245 |
| 5,768,888 | A | * | 6/1998 | Matros et al. | 60/274 |
| 5,902,970 | A | * | 5/1999 | Ferri | 181/249 |
| 5,928,618 | A | | 7/1999 | Maganas et al. | 423/212 |

OTHER PUBLICATIONS

Durham et al., *Carbothermal Synthesis of Silicon Nitride: Effect of Reaction Conditions*, 31–37, 211, 213–215, J. Am Ceram, Soc., vol. 74 [1](1991).

Guedes De Carvalho et al., *Mass Transfer Around Carbon Particles Burning In Fluidised Beds*, 63–70, Trans. IChemE., vol. 69, Part A (1991).

Homsy et al., *Report Of A Symposium On Mechanics Of Fluidized Beds*, 477–495, J. Fluid Mech., vol. 236 (1992).

Jean et al., *Fluidization Behavior Of Polymeric Particles In Gas–Solid Fluidized Beds*, 325–335, Chemical Engineering Science, vol. 47, No. 2 (1992).

Kuipers et al., *A Numerical Model Of Gas–Fluidized Beds*, 1913–1924, Chemical Engineering Science, vol. 47, No. 8 (1992).

Molerus, O., *Heat Transfer In Gas Fluidized Beds. Part 1*, 1–14, Powder Technology, 70 (1992).

Shafey et al., *Experimental Study On A Bench–Scale, Batch–Type Fluidized–Bed Combustor For Energy Production From Waste–Derived Fuels*, 331–338, Energy, vol. 17, No. 4 (1992).

Conversion Technology, Inc., *Source Test Report: Fluid Bed Stripping For Particulates, Metals, POHCS*, (1991).

Seghers Engineering, *Segers Zerofuel: A Concept For Autothermal Sludge Incineration* (1992).

* cited by examiner-

METHODS AND APPARATUS FOR LOW BACK PRESSURE MUFFLING OF INTERNAL COMBUSTION ENGINES

RELATED APPLICATION

This application claims the benefit under 35 U.S.C. §119 of earlier filed U.S. provisional application Serial No. 60/183,088, filed Feb. 15, 2000. For purposes of disclosure, the foregoing provisional application is incorporated herein by specific reference.

BACKGROUND OF THE INVENTION

1. Field of the Invention

The present invention is in the field of muffling apparatus used to reduce the sound emitted by internal combustion engines. More particularly, the present invention involves methods and systems for muffling the sound emitted by internal combustion engines while maintaining low back pressure for improved power and fuel economy. The methods and systems employ a bed of silica, alumina or other appropriate particulate material for absorbing and/or disrupting sound waves.

2. Review of the Relevant Technology

Internal combustion engines are ubiquitous in modern life but have the drawback of producing considerable noise, particularly from the exhaust pipe. To effectively muffle and reduce engine noise to within acceptable levels, exhaust pipes are typically equipped with sophisticated channeling and baffling schemes. Because muffling systems typically involve restricting the free flow of exhaust gasses in order to disrupt or otherwise dampen the sound waves generated by the operation of the engine, mufflers can create significant "back pressure", known to reduce fuel economy and power. The use of catalytic converters in-line with conventional muffling systems further increases back pressure.

Back pressure inherently reduces fuel economy and engine power by increasing the amount of work that the engine must perform just to emit the waste exhaust gases into the air. It also reduces power by generally requiring an increase in the fuel to air ratio that is fed into the cylinders in order for the engine to run properly. Conversely, reducing back pressure, such as by the use of expensive "headers" or other muffling systems rather than conventional mufflers allows for a leaner fuel/air mixture, thus resulting in greater generation of power per quantity of fuel used. Reducing back pressure also reduces the amount of work that the engine must perform to emit waste exhaust gases. Unfortunately, headers or other low back pressure muffling systems are costly and generally not approved for conventional vehicles, but are reserved for racing vehicles, because they do not meet present noise reduction standards.

In view of the requirement that vehicles with internal combustion engines must be equipped with muffling systems which meet relevant government noise reduction standards, but in view of other standards relating to the need to reduce pollution and improve fuel economy, there is inherently a tension or conflict with noise reduction goals, on the one hand, and fuel economy and emissions reduction, on the other. The result of this tradeoff is generally reduced power and vehicular performance.

It is obvious that improving fuel economy generally reduces the quantity of emissions produced by a vehicle. It is also true that deriving more power per quantity of fuel generally translates into better fuel economy and reduced emissions. One way to do this would be to reduce the back pressure resulting from conventional muffling systems. The problem with this strategy is that there are presently no reasonably priced or sized muffling systems that are capable of significantly reducing back pressure while satisfying present vehicle noise standards.

Another source of back pressure are in-line catalytic converters, which are required in order to reduce emissions from gasoline powered vehicles. Although catalytic converters themselves might not create as much back pressure as conventional mufflers, the back pressure imparted by a catalytic converter is cumulative to the back pressure created by the muffler in the same exhaust system, thus further reducing fuel economy and engine power.

In view of the foregoing, it would be an significant advancement in the art to provide improved methods and systems for effectively and inexpensively muffling the sound emitted by internal combustion engines while substantially reducing back pressure compared to conventional mufflers.

It would be a further advancement in the art to provide methods and systems for muffling the sound emitted by internal combustion engines which were simultaneously capable of substantially reducing back pressure compared to conventional mufflers while meeting or exceeding present noise reduction standards.

It would be a tremendous advancement in the art if such methods and systems for muffling the sound emitted by internal combustion engines were capable of reducing back pressure so as to improve fuel efficiency and increase engine power, while also providing equal or greater muffling of engine sounds compared to conventional mufflers.

Finally, it would be an enormous advancement in the art if such methods and systems for muffling the sound emitted by internal combustion engines were adaptable so as to also be capable of reducing pollutants found in exhaust emissions such that they provided the duel purpose of reducing engine noise and engine pollution.

Such methods and systems for muffling the sound emitted by internal combustion engines while reducing back pressure, increasing engine power and, optionally, reducing engine emissions are disclosed and claimed herein.

SUMMARY AND OBJECTS OF THE INVENTION

The present invention encompasses improved methods and systems for muffling engine sounds emanating from the exhaust system of internal combustion engines. Such muffling methods and systems employ a muffling chamber filled with an appropriate particulate media capable of absorbing or otherwise disrupting the sound waves found in the exhaust stream corresponding to engine noise. Because moving exhaust gases are able to more freely pass through the spaces between the individual particles comprising the particulate media than through baffling and dampening devices found in conventional mufflers, the muffling systems of the present invention are able to muffle sound while reducing back pressure compared to conventional mufflers. In turn, greatly reducing the back pressure substantially improves the power and fuel efficiency of the engine.

The inventive muffling systems according to the invention preferably include one or more exhaust muffling chambers, which include muffling particles disposed therein, in gaseous communication with an internal combustion engine. The sound waves generated by the explosions within the cylinders of internal combustion engines are concentrated within and directed through the exhaust pipes or conduits connected to the engine. As the exhaust gases pass through the one or more exhaust muffling chambers the sound waves contained therein and propagated thereby are widely scattered, and thus dissipated and muted, by the surrounding particulate media. More particularly, a diffusion pipe is at least partially sunk beneath a volume of muffling particles so that the exhaust gases are passed from the diffusion pipe into the surrounding muffling particles. It is believed that the particulate muffling particles act to scatter and redistribute the sound waves throughout the muffling chamber in a manner that causes a substantial portion of the sound waves to become substantially out of phase and thus able to cancel each other out. This reduces the amplitude and, hence, the volume of the sound represented by the at least partially cancelled out sound waves.

An example of an appropriate particulate material capable of muffling sound from an internal combustion engine is silica sand. Another is alumina. Silica and alumina are preferred because they are also capable of catalytically degrading waste gases and particulates found in the exhaust gases from internal combustion engines, as more fully explained: in U.S. Pat. No. 5,928,618 and co-pending U.S. application Ser. Nos. 09/257,458 and 09/307,145. For purposes of disclosing methods and systems for catalytically degrading unburnt particulates and hydrocarbons in waste exhaust gases from an internal combustion engine and other systems that burn fossil fuels, the foregoing patent and applications are incorporated herein by specific reference.

In addition to providing catalytic degradation of unburnt hydrocarbons in waste exhaust gases, silica sand is also preferred because of its extremely low cost and ready availability. Nevertheless, virtually any particulate having an average particle size from about 0.0.1 mm to about 1 cm would work in muffling the sounds emitted by internal combustion engines. Particles having a size in a range from about 0.1 mm to about 5 mm are especially preferred. Virtually any geologic material can be ground and graded into appropriate particles within the scope of the present invention. In addition, synthetically formed spheres or other particles, such as ceramic, glass or metallic spheres, are certainly within the scope of the present invention. The muffling particles according to the present invention can optionally be coated with a catalytically significant quantity of an appropriate catalytic metal or other catalyst material capable of catalytically oxidizing or otherwise degrading waste particulates and/or unburnt hydrocarbons emitted by an internal combustion engine.

Silica and alumina have been found to be catalytically reactive under appropriate conditions. Such particles are believed to be capable of generating highly reactive hydroxyl and other oxidative moieties on their surface under such conditions. In contrast to the generally accepted view that silica and alumina are inert fluidized bed particles, the inventors of the present technology have discovered that an abundance of very reactive hydroxyl radicals and other reactive hydrogen oxide species (and possibly other oxide species) are apparently generated which are capable of catalytically degrading soot, unburnt hydrocarbons and other incomplete combustion products into $CO_2$ and/or water at temperatures below combustion temperatures. It is believed that moisture present in many exhaust streams as well as other organic matter that has been tested creates a surface phenomenon on the silica and alumina particles that actually allows for the catalytic conversion of incomplete combustion products into $CO_2$ and water.

In a preferred embodiment, the silica and/or alumina particles are suspended or fluidized in a fairly static condition against the force of gravity by means of air flowing upwards through the particles. Such airflow can be provided by any gas pressurizing means known in the art, including turbines, pumps, the inherent pressure generated by internal combustion engines, and combinations of the foregoing. Suspending or fluidizing the particles greatly increases the active surface area of the silica and/or alumina particles by separating them slightly and allowing for more gas-to-particle contact. Through chemical mechanisms not wholly understood, the environment immediately on or surrounding the surfaces of the suspended particles is able to catalytically degrade soot, unburnt hydrocarbons and other incomplete combustion products generated by the burning of carbon-containing fuels.

Another advantage of fluidizing, suspending or otherwise separating the silica, alumina or other muffling particulates is that doing so allows for easier flow-through of waste exhaust gases. This, in turn, assists in further reducing back pressure to the internal combustion engine. This results in increased fuel economy and power, with a concurrent decrease in overall emissions generated by the internal combustion engine. Another interesting aspect of the invention is the greatly reduced temperature of the exhaust gases passing through the inventive muffling systems compared to conventional mufflers.

In the case where it is desired for the muffling particles to also catalytically degrade waste particulates and unburnt hydrocarbon gases, the reaction or muffling chamber in which the muffling particles are contained is preferably maintained at a temperature in a range from about 50° C. to about 500° C., more preferably in a range from about 100° C. to about 400° C., and most preferably in a range from about 150° C. to about 350° C. Such temperatures are preferred in view of their being generally within the temperature range of exhaust gases generated by internal combustion engines after passing through the exhaust system. Although such temperatures are preferred, the catalytic oxidation of soot, hydrocarbons and other incomplete combustion products of carbon-containing fuels at any temperature through the use of silica and/or alumina would be within the scope of the present invention. The preferred temperature ranges are also considerably less than the operating temperature within conventional mufflers, which are typically between about 900–1200° F.

The heat necessary to maintain the reaction chamber within the desired temperature range can be provided by any source. In a preferred embodiment, the heat will be provided substantially, or even exclusively, by the exhaust gases themselves. Nevertheless, it is certainly within the scope of the invention to supplement the heat found in exhaust gases by means of electric heaters, burning fuels such as methane gas, by recycling heat recovered from other sources, or by any other heat source that is able to provide a desired quantity of heat in order to maintain the reaction chamber within a desired temperature range.

In a preferred embodiment, the means for introducing the waste exhaust gases from the internal combustion engine to the muffling/reaction chamber comprises one or more porous tubes. The term "porous tubes" denotes pipes or tubes which include a plurality of holes therein for directing the waste exhaust gases in a desired direction. Preferably, the gas introducing means comprises a plurality of porous tubes radiating outwardly in a spoke-like configuration from a central point, typically an exhaust pipe communicating with the exhaust manifold of an internal combustion engine.

Because of the extreme simplicity of the apparatus used to carry out the muffling/reaction processes of the present invention, it is possible to greatly up-size or down-size the muffling reaction apparatus to accommodate a wide variety of uses and applications. The reaction chambers may be very large or utilized in series in order to serve large industrial needs such as coal or petroleum fired power plants, smelters and the like. The muffling/reaction chambers may be sized for use with diesel engines used to pull trains. They may: be down-sized and adapted for use in catalytically treating exhaust gases produced by conventionally-sized internal combustion engines, e.g., diesel-, gasoline-, and propane-powered engines.

Exhaust gases from the burning of carbon-containing fuels typically comprises incomplete combustion products, which may include carbon soot, gaseous, liquid or particulate hydrocarbons, carbon monoxide, and diatomic hydrogen, among other compounds. Actual laboratory testing has shown that passing exhaust gases produced by a diesel engine through a reaction chamber containing a bed of silica particles greatly reduces both the level of soot produced by the combustion of diesel fuel as well as carbon monoxide. Such pollutants are believed to be converted into $CO_2$ or a mixture of $CO_2$ and water. In addition, nitrogen oxides (NOx) are reduced by about 90%, presumably to nitrogen gas or silicon nitride while carbon, carbon monoxide, and hydrocarbons are being oxidized, presumably to carbon dioxide and water. Perhaps the reactions are interrelated.

Nevertheless, for reasons not entirely understood, even though the levels of carbon, carbon monoxide, and hydrocarbons are greatly reduced using the inventive systems, the measured level of carbon dioxide also appears to drop off, even precipitously in some cases, thus suggesting that the carbon dioxide may be converting to something else, at least temporarily.

The back pressure exerted by the inventive muffling systems is considerably lower than conventional muffling systems. At idle back pressures of about 5 inches of water have been measured, which increase to about 25–30 inches at full load. By comparison, standard conventional mufflers create 40 inches of back pressure at full load.

In view of the foregoing, it is an object of the invention to provide improved methods and systems for effectively and inexpensively muffling the sounds emitted by internal combustion engines while substantially reducing back pressure compared to conventional mufflers.

It is a further object and feature of the invention to provide methods and systems for muffling the sound emitted by internal combustion engines which are simultaneously capable of substantially reducing back pressure compared to conventional mufflers while meeting or exceeding present noise reductions standards.

It is yet another object and feature that such methods and systems for muffling the sound emitted by internal combustion engines are capable of reducing back pressure so as to improve fuel efficiency and increase engine power, while also providing equal or greater muffling of engine sounds compared to conventional mufflers.

It is another object of the invention that such methods and systems for muffling the sound emitted by internal combustion engines are adaptable so as to also be capable of reducing pollutants found in exhaust emissions such that they provide the dual purpose of reducing engine noise and engine pollution.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity in detail to the use of the accompanying drawings in which.

DETAILED DESCRIPTION OF THE PREFERRED EMBODIMENTS

Figure 1:
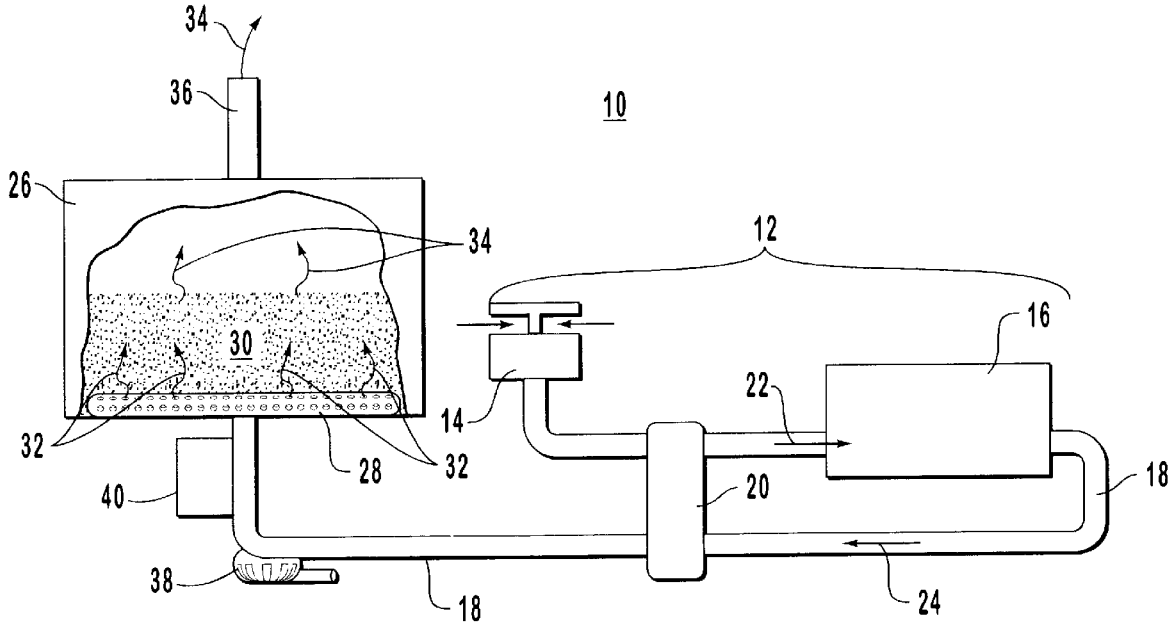
FIG. 1 is a cross-section view of a preferred muffler/reaction chamber used in combination with an internal combustion engine for oxidizing incomplete combustion products.

The present invention relates to improved methods and systems for muffling the sounds emitted by internal combustion engines. Such methods and systems may optionally be adapted for catalytically oxidizing incomplete combustion products produced by the burning of carbon-containing fuels. Such methods and systems may be used, for example, in the muffling of sounds and the catalytic oxidation of incomplete combustion products produced by internal combustion engines, such as diesel engines, and industrial burners, such as power plants, metallurgical smelting and the like.

Carbon-containing fuels, when not completely oxidized during combustion, can yield finely divided carbon particles (soot), unburnt hydrocarbons, carbon monoxide, hydrogen gas, and the like. In an effort to design methods and systems for catalytically degrading pollutants found in waste exhaust gases generated by an internal combustion engine, the inventors were surprised to learn that a bed of silica sand also provided a superior muffling system. In particular, waste exhaust gases from a diesel engine were passed through a bed of silica sand designed to catalytically degrade the pollutants found in the waste exhaust gas stream. The particular vehicle that was purchased to undergo this experiment was not equipped with a muffler. Therefore, the waste exhaust gases were passed "unmuffled" directly into the bed of silica sand for the purpose of testing the extent of catalytic degradation of the pollutants found therein. To the surprise of the inventors, there was a substantial drop in the decibel level generated by the diesel engine upon directing the waste exhaust gases through the bed of silica sand. The drop in decibel level was comparable, and possibly superior, to the degree of muffling of a conventional muffler stack used to muffle the sound of diesel powered tractor trailer rigs.

In particular, when the inventors used the inventive muffling system on a 350 Cummins diesel engine, the sound coming out of the muffling system, subtracting and accounting for the noise coming off the engine external to the exhaust system, was measured at only 75 decibels. In general, the inventive muffling systems will limit the engine sounds emitted therefrom to well below OSHA's permissible noise exposure of 90 dbA for an eight hour shift of continuous noise at that level.

Not only did the muffling system equal or exceed the ability of conventional mufflers to reduce sound output, it did so while creating far less back pressure to the engine compared: to conventional mufflers. Whereas typical mufflers create back pressure, measured in inches of water, of seven inches when idling, the bed of silica sand according to the present invention yielded back pressures of between about 3–3½ inches of water. When pulling a load at a typical engine speed of 2800 RPMs, back pressure as using conventional mufflers are 40 inches of water. In contrast, the muffling/degradation apparatus according to the present invention yield back pressures of between 15–30 inches of water at 2800 RPMs.

In a preferred embodiment, the invention relates to improved methods and systems for catalytically oxidizing incomplete combustion products found in exhaust that is generated by the burning of fossil fuels by internal combustion engines and industrial burners. In a most preferred embodiment, such methods and systems are especially useful in treating the incomplete combustion products produced by diesel engines. The incomplete combustion products (usually together with the entire exhaust stream) are passed through a reaction chamber containing a bed of silica, alumina or a mixture thereof. Through mechanisms which are not entirely understood it has been found that a bed of silica, without any special catalysts added thereto, is somehow able to catalytically oxidize the vast majority of carbonaceous soot and carbon monoxide found in the exhaust stream. Alumina is also believed to work in catalytically oxidizing incomplete combustion products, although silica is preferred.

The terms "degrade" or "degradation", as used in the specification and the appended claims, refer to the breakdown of larger organic molecules within the organic waste material into smaller organic molecules, mainly through the catalytic cleavage of carbon-carbon bonds. These terms shall also refer to the cleavage of any other molecular bonds during the process of gasifying and oxidizing. The terms also include the complete oxidation of organic gases or particulates into carbon dioxide, water, and/or other oxidation products.

The term "incomplete combustion products", as used in the specification and the appended claims, shall refer to incompletely oxidized reaction products that are formed during combustion or other rapid or incomplete oxidation processes involving carbon-containing fuels. The incomplete combustion products may consist of, for example, gases, solid particulates, liquids, or mixtures thereof. Incomplete combustion products typically include carbon soot, unburnt hydrocarbons, whether in particulate or in vaporous form, carbon monoxide, hydrogen gas, and the like. The term "carbon soot" is a subset of the term "incomplete combustion products" and includes unburnt and residual carbonaceous and hydrocarbon particulates.

The term "carbon-containing fuel" shall be understood to refer to any organic material that may be combusted or burned in order to generate or release energy, usually in the form of heat, light or a combination thereof. The term "fossil fuel" is a subset of "carbon-containing fuel" and includes coal, oil, natural gas, derivatives of coal, natural gas and oil, and the like.

Reference is now made to the muffler/degrader depicted in FIG. 1, which illustrates a first embodiment of a muffling/catalytic system 10 adapted for use in treating the incomplete combustion products produced by an internal combustion engine. The internal combustion engine may be a diesel engine 12, or may alternatively be other internal combustion engines or other devices that burn fossil fuels. Muffling/catalytic system 10 functions to more fully oxidize the incomplete combustion products of an internal combustion engine in a fashion similar to conventional catalytic converters but without the need for expensive metallic catalysts, such as palladium, platinum and the like.

A typical diesel engine 12 comprises an air intake 14, a combustion chamber 16, and an exhaust channel 18. A turbocharger 20 is configured to compress an intake air/fuel mixture 22 that is fed into the combustion chamber 16 in order to increase the efficiency of the diesel engine 12 by supplying more combustion air initially. The turbocharger is often configured to communicate with the exhaust channel 18, with the flow of exhaust gases providing force for driving the turbocharger.

Waste exhaust products 24 are discharged from the combustion chamber 16 into the exhaust channel 18. In FIG. 1, the exhaust channel 18 is depicted as providing an uninterrupted conduit that directs the waste exhaust products 24 into a muffling and/or reaction chamber 26. However, any appropriate means for introducing the waste exhaust products 24 into the muffling and/or reaction chamber 26 may be employed. The majority of waste exhaust products 24 typically consist of inert nitrogen gas, carbon dioxide, water, and some oxygen gas. However, due to non-ideal air/fuel ratios, incomplete mixing, inefficiencies inherent during acceleration, or other reasons, some of the diesel fuel used in diesel engine 12 may not be completely burned into $CO_2$ and water. As a result, incomplete combustion products, most notably carbon soot, unburnt particulate and gaseous hydrocarbons, and carbon monoxide are produced in significant quantities by the diesel engine 12. Such incomplete combustion products are often visible, particularly during the acceleration phase of a diesel powered vehicle when combustion is least efficient.

Figure 6:
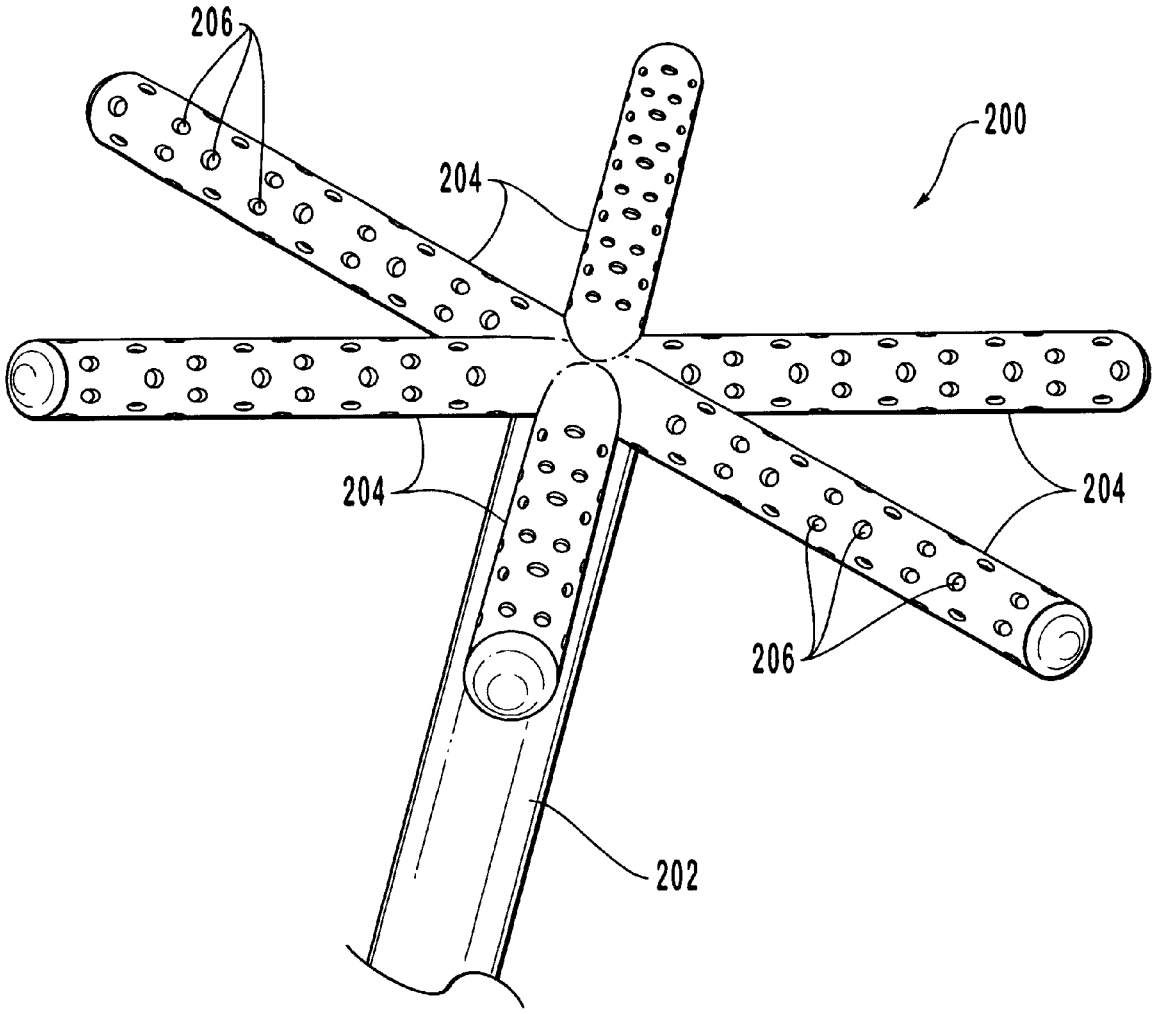
FIG. 6 is a top perspective view of a preferred diffusion pipe, tube or conduit for inputting waste exhaust gases into a muffler/reaction chamber according to the invention.

The waste exhaust products 24 are introduced into the muffling and/or reaction chamber 26 by means of one or more diffusion pipes 28. The diffusion pipe 28 includes a plurality of holes or passages distributed therethrough which allows for a desired distribution pattern of the waste exhaust products 24 throughout the muffling and/or reaction chamber 26. A more preferred diffusion pipe 200 is depicted in FIG. 6 and discussed more fully below. The waste exhaust products 24 are more particularly diffused throughout catalytically reactive particles 30 located within the muffling and/or reaction chamber 26 as diffused exhaust gases 32. The muffling and/or reactive particles 30 consist essentially of silica, alumina, or mixtures thereof. The term "consist essentially of" should be understood to mean that the catalytically reactive particles mainly consist of silica, alumina or mixtures thereof, but they may include minor quantities of impurities such as metals and ash typically found in silica and/or alumina. Moreover, whereas the silica and/or alumina are themselves catalytically reactive such that expensive catalysts such as palladium and platinum are unnecessary, inclusion of such materials in minor amounts in order that the silica and/or alumina still perform the majority of catalytic activity would be within the scope of the present invention.

In a preferred embodiment the catalytically reactive and/or muffling particles 30 are "fluidized," as that term is understood in the art, meaning that at least a portion of the particles are elevated by rising gases such that they are not in a state of natural particle packing density. Fluidizing or elevating the particles leaves them in a much less compacted state. This fluidized or elevated state yields particles having a surface area that is more accessible and available for contact with the diffused exhaust gases 32 rising through the particles 30. Increased surface contact with the diffused exhaust gases 32 increases the catalytic activity of the reactive particles 30 vis-a-vis the diffused exhaust gases 32. As the diffused exhaust gases 32 rise through the muffling particles 30 they are catalytically oxidized into reaction products having a higher oxidation state, such as carbon dioxide, water and some ash. As they rise through, and are catalytically oxidized by, the catalytically reactive, particles the diffused exhaust gases 32 become treated exhaust gases 34. The treated exhaust gases 34 exit the muffling and/or reaction chamber 26 by means of an outlet or stack 36.

As stated above, it is preferable for the particles 30 to be in a fluidized or suspended state in order to increase their available surface area and ability to catalytically react with the diffused exhaust gases 32. In some cases, the waste exhaust products 24 themselves will have sufficient pressure to cause the particles 30 to become fluidized or otherwise partially suspended. However, in the case where the waste exhaust products 24 have insufficient pressure to cause adequate fluidization or levitation of the particles 30, it may be necessary, or at least preferable, to increase the pressure of the waste exhaust products 24 prior to their being introduced into the muffling and/or reaction chamber 26. This may be done by means of an optional compressor 38 or other compressing means known in the art. In many cases the pressure of the waste exhaust products 24 will depend on the rate at which the diesel engine is consuming diesel fuel and will typically correspond to the number of RPMs at which the engine is running. At higher RPMs the exhaust gases will typically have adequate pressure to cause at least partial fluidization of the catalytically reactive and/or muffling particles 30. However, at lower RPMs the waste exhaust products 24 may require assistance by means of the aforementioned compressor 38.

An information feed-back mechanism (not shown) may be utilized to determine whether or not the compressor 38 needs to be activated at any particular point in time as well as the degree of pressurization to be imparted to the waste exhaust products 24. One of ordinary skill in the art will be able to adjust the amount of compression imparted by the compressor 38 depending on the requirements of the overall catalytic system 10.

When catalytically degrading unburnt hydrocarbons within waste exhaust gases, it is preferable for the reaction chamber 26 to be maintained at a temperature in a range from about 50° C. to about 500° C., more preferably in a range from about 100° C. to about 400° C., and most preferably in a range from about 150° C. to about 350° C. Such temperatures are preferred in view of their being generally within the temperature range of waste exhaust gases generated by internal combustion engines after passing through the exhaust system. Although such temperatures are preferred, the catalytic oxidation of soot, hydrocarbons and other incomplete combustion products of carbon-containing fuels at any temperature by means of silica and/or alumina particles is within the scope of the invention.

Waste exhaust products 24 typically leave the diesel engine 12 off turbo at a temperature of about 833° C. at full load and a back pressure of about 29 inches. The diffusion pipe 28 is responsible for creating most, if not all, of the back pressure, rather than the catalytically reactive or other muffling particles 30. However, the waste exhaust products 24 typically begin to cool after leaving the diesel engine 12 and after passing through the exhaust channel 18. In order to preserve as much of the heat generated by the diesel engine 12 as possible it is preferable to position the reaction chamber 26 in relation to the diesel engine 12 so that the waste exhaust products 24 do not cool to temperatures below the preferred operating temperature of the catalytic system 10. In addition, various insulating means known in the art may be utilized in order to preserve a desired amount of the heat produced by burning fuel within the diesel engine 12 and found within the waste exhaust products 24 as they leave combustion chamber 16.

Nevertheless, the operating temperature of the muffling system according to the invention is considerably lower than conventional mufflers. One manufacturer of diesel engines reported that at idle the temperature within the interior of the muffler is 1120°0 F., and 950° when revving at higher RPMs. In contrast, the temperature of the gases at the bottom of the inventive muffling systems according to the invention have been measured at about 275° F. The temperature of such gases as they leave the top of the chamber 26 drops to about 125° F., thought to occur at least in part due to the catalytic reactions occurring within the reaction/muffling chamber 26. The EPA has recently stated that even more modest temperature drops could increase mileage and reduce emissions, thus indicating the tremendous benefit or the temperature drops according to the invention.

In the event that it is desired to increase the temperature of the waste exhaust products 24, it may be desirable to utilize an optional auxiliary heater 40 in order to increase the temperature of the waste exhaust products 24 prior to their entering into the reaction chamber 26. In addition, the auxiliary heater 40 may optionally be configured so as to provide moisture as needed to maintain the reactivity of the catalytically reactive particles. Nevertheless, the waste exhaust products 24 will themselves generally provide adequate moisture in the form of combustion water produced by the oxidation of hydrocarbons.

In alternative embodiments, the fluidization of catalytically reactive particles 30 may be carried out by means of auxiliary air jets or the like (see FIG. 3) which act independently of the force of the waste exhaust products 24 being introduced into reaction chamber 26 through the diffusion pipe(s) 28. In addition, auxiliary heating means (see FIG. 3) located within reaction chamber 26 may be used in order to maintain reaction chamber 26 at a desired temperature, particularly at start up when the diesel engine is cold and the waste exhaust products 24 are too low to maintain reaction chamber 26 at the desired temperature. Finally, in the event that the waste exhaust gases are too hot such that their temperature is higher than the desired operating temperature of reaction chamber 26, it may be necessary to provide cooling means (not shown) in order to maintain the waste exhaust products 24 at a desired temperature.

It is also advantageous to select catalytic reactive particles 30 that have a relatively high specific surface area. It is believed that it is at the surface of the reactive particles 30 where the reactive hydroxyl radicals are generated. Accordingly, increasing the surface area of the particles 30 without increasing their weight allows for the use of a lower mass of reactive particles 30 while maintaining a desired level of reactivity of the catalytic system 10. Reduced weight is particularly desirable in the present embodiment, since muffling and/or reaction chamber 26 is typically installed in and carried by a diesel-powered vehicle. The amount of silica and/or alumina particles that are needed may be significantly reduced when the grain size is reduced and/or the surface of the particles is made to be more irregular, both of which tend to increase the specific surface area of the particles.

It should also be appreciated that reducing the amount of silica or other reactive particles generally reduces the percentage of carbon soot and other incomplete combustion products that are removed from waste exhaust products 24. Thus, the preferred amount of silica and/or alumina is determined by a trade-off involving the weight of the catalytic system 10 on the one hand, and the extent to which one wishes to catalytically oxidize the waste exhaust products 24 on the other.

The catalytically reactive particles 30 facilitate the oxidation of the incomplete combustion products found in the waste exhaust products 24. In particular, at least carbon soot and unburnt hydrocarbons and other organic gases are converted into carbon dioxide, water, or other degradation products, while other incomplete combustion products may be converted into more fully oxidized counterparts. Even carbon monoxide found in diesel exhaust has been shown to be greatly reduced when diesel exhaust is passed through fluidized: silica particles. In practice, the inside of the diffusion pipe 28 experiences a considerable buildup of soot and oily hydrocarbons found in the exhaust gases, which would be expected. On the other hand, the diffusion pipe holes adjacent reactive silica particles were found to be totally clean, thus demonstrating the effectiveness of the reactive silica particles in catalytically degrading soot and hydrocarbons.

The catalytic system 10 also acts as an efficient muffling system that dampens and muffles sounds emitted by an internal combustion engine. In the event that the muffling system is also used to catalytically degrade waste exhaust products, the catalytic system 10 will include the aforementioned silica and/or alumina particles. Alternatively, if the muffling system is intended for use only in muffling the sounds emitted by an internal combustion engine, the particles may comprise virtually any solid particulate. Preferred particles have an average diameter of about 0.01 mm to about 1 cm, more preferably an average diameter of about 0.1 mm to about 5 mm. The advantage of using an apparatus according to FIG. 1 instead of a conventional muffler the inventive system is able to adequately muffle sound while greatly reducing back pressure. This in turn increases power and fuel efficiency of the invention.

Figure 2:
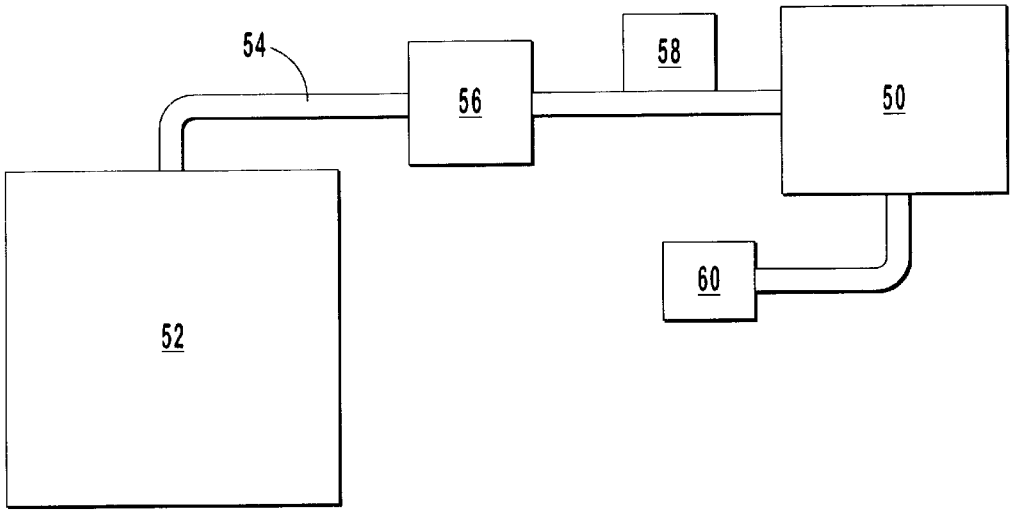
FIG. 2 is a schematic view of a reaction chamber used in combination with an exhaust flue of an industrial burner.

The catalytic systems according to the present invention can be modified, such as by upscaling or downscaling, to catalytically oxidize virtually any waste exhaust streams that include incomplete combustion products of carbon-containing fuels. For example, FIG. 2 is a schematic diagram depicting a reaction chamber 50 upsized and configured for use in catalytically oxidizing incomplete combustion products produced by an industrial burner 52. Such industrial burners 52 commonly burn coal, coke, fuel oil, natural gas, or derivatives of coal, petroleum or natural gas, all of which are capable of generating incomplete combustion products such as soot, unburnt or partially burnt hydrocarbons, and carbon monoxide. Industrial burners 52 are utilized in a wide range of industrial operations, such a power generation, metal smelting, manufacturing, and the like.

Exhaust gases produced by the industrial burner 52 are carried from the burner 52 to the reaction chamber 50 by means of an exhaust conduit or channel 54. A compressor 56 may be used to ensure that the exhaust gases produced by the industrial burner 52 are fed into reaction chamber 50 with adequate pressure. An in-line introducer of auxiliary inputs 58 may be used in order to ensure adequate heat and/or moisture content of the exhaust gases before they are introduced into the reaction chamber 50. In addition, or alternatively, heat and/or moisture may be introduced by means of an off-line or parallel introducer of auxiliary inputs 60 connected separately to the reaction chamber 50. Introducer 60 may also be used to independently fluidize or at least partially suspend the catalytically reactive particles of silica or alumina located within the reaction chamber 50.

Figure 3:
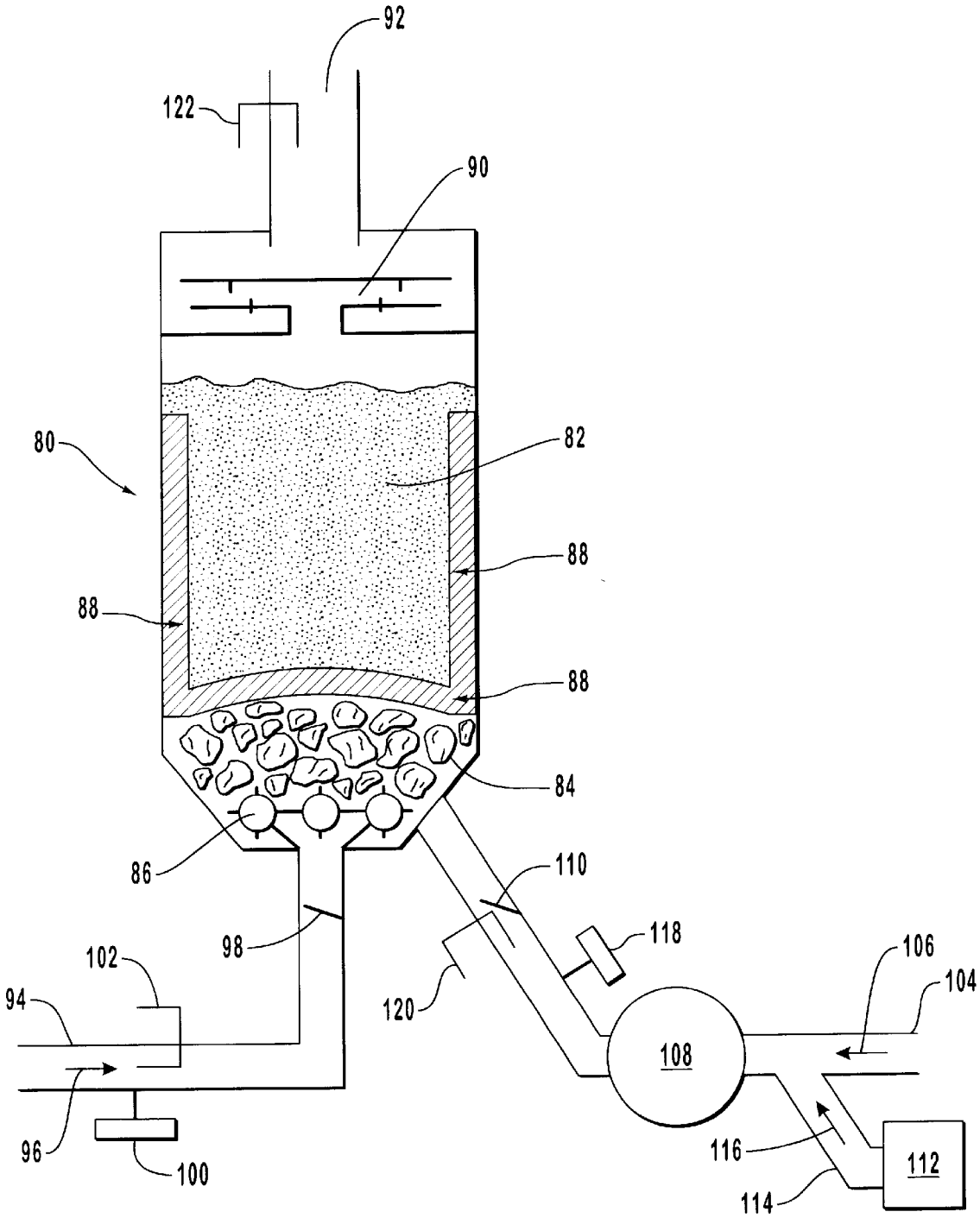
FIG. 3 is a cross-section view of an alternative embodiment of a muffler/reaction chamber according to the invention.

In order to illustrate another preferred embodiment of a catalytic and/or muffling system according to the present invention, reference is now made to FIG. 3. Depicted therein is a reaction chamber 80 that includes therein catalytically reactive particles 82 comprising silica, alumina or a combination thereof. The bed of catalytically reactive particles 82 sits atop a bed of rocks 84 surrounding porous introduction tubes 86 in order to more evenly distribute waste exhaust gases emitted by the porous tubes 86 and into the catalytically reactive particles 82. An auxiliary heating element 88 that provides resistive heat is disposed around the inner circumference of the reaction chamber 80 in order to provide additional heat if needed during operation of the reaction chamber 80. Exhaust gases that have been treated by reaction chamber 80 are preferably removed from the reaction chamber 80 by passing them through a cyclone filter 90 and out an exhaust stack 92.

Exhaust gases 96 are introduced into the reaction chamber 80 by means of an exhaust channel 94 communicating between reaction chamber 80 and an internal combustion engine (not shown), such as a diesel engine or some other source of waste gases, such as an industrial burner. The exhaust channel 94 may further be equipped with an anti-backflow trap 98 in order to ensure essentially one-way flow of exhaust gases 96 into the reaction chamber 80. The exhaust channel 94 may optionally be equipped with a pressure tube 100 for measuring the pressure of the exhaust gases 96. A Pitot tube 102 may also be employed to measure the velocity of the exhaust gases 96.

In order to assist the exhaust gases 96 in heating, and/or fluidizing the catalytically reactive particles 82 within the reaction chamber 80, an optional auxiliary air input system may be employed. Such an auxiliary input system preferably includes an air input channel 104 through which air 106 can be introduced into the reaction chamber 80. The air is compressed and accelerated by means of an air turbine 108. An anti-backflow trap 110 may be used to ensure one-way flow of air 106 into the reaction chamber 80 and in order to prevent unwanted escape of exhaust gases 96 through the air input channel 104.

An optional heating unit 112 may also be employed for introducing heated air into air input channel 104. A heated air channel 114 communicating between the heating unit 112 and air input channel 104 directs heated air 116 into air channel 104. An optional pressure tube 118 may be used to measure pressure, while an auxiliary Pitot tube 120 may be used to measure the velocity, of the air 106 being input into the reaction chamber 80. Finally, a Pitot tube 122 may be used within the exhaust stack 92 in order to measure the velocity of the treated exhaust gases exiting the exhaust stack 92.

Figure 4:
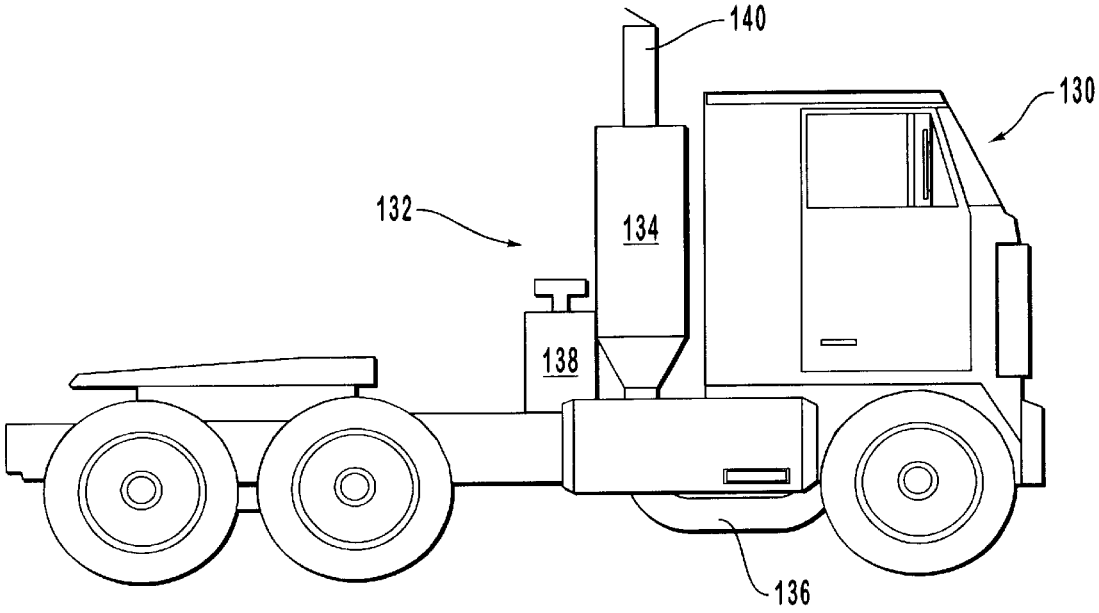
FIG. 4 is a partial cross-section view of a muffler/reaction chamber sized and configured for use with a diesel-powered tractor-trailer rig.

FIG. 4 depicts a diesel tractor trailer 130 equipped with a catalytic system 132, more particularly a reaction chamber 134, sized and configured for convenient use with the tractor-trailer 130. Exhaust gases from the tractor-trailer are introduced into the reaction chamber 134 by means of an exhaust channel 136. A turbine 138 may be used to introduce additional air into the reaction chamber 134 in order to provide adequate fluidization of catalytically reactive particles located therein. In addition, or alternatively, the turbine 138 may be used to increase the pressure of the exhaust gases themselves before being introduced into the reaction chamber 134. The treated exhaust gases are expelled from the reaction chamber 134 through an exhaust stack 140. The catalytic system 132 also provides excellent muffling of engine sounds such that the mufflers conventionally used with diesel-powered tractor/trailers can be eliminated. By doing so, back pressure to the engine is greatly reduced.

Figure 5:
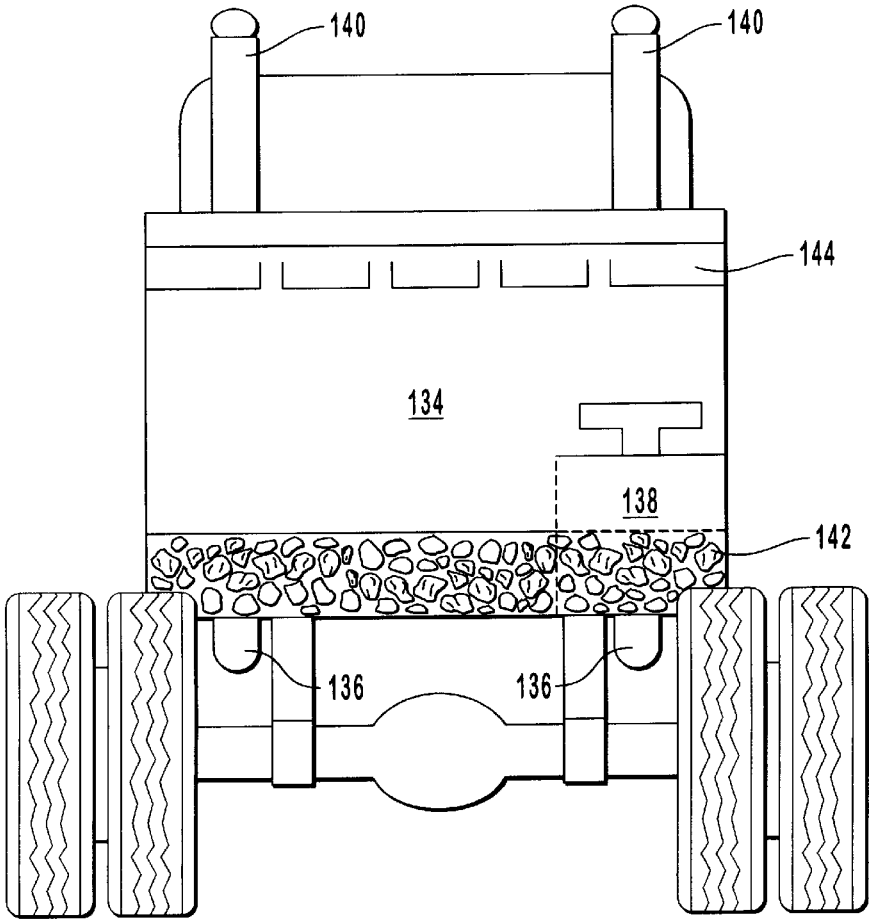
FIG. 5 is a rear cross-section view of a muffler/reaction chamber configured to approximate the width of a diesel-powered tractor-trailer rig.

FIG. 5 is a rear view of the catalytic system 132 depicted in FIG. 4 showing that the reaction chamber 134 can occupy substantially the entire width of the tractor trailer 130. FIG. 5 further depicts a bed of rocks 142 used to assist the distribution of waste exhaust gases throughout the reaction chamber 134, as well as cyclone filters 144 through which the treated exhaust gases pass before escaping through the exhaust stacks 140.

FIG. 6 is a top perspective view of a preferred diffusion pipe 200 according to the present invention. The diffusion pipe 200 is the preferred means for introducing waste exhaust gases into the muffler/catalytic systems according to the present invention. The diffusion pipe 200 more particularly includes a central pipe 202 in gaseous communication with an internal combustion engine. A plurality of diffusion tubes 204 in gaseous communication with the central pipe 202 distribute the gases evenly throughout the muffling/catalytic system, more particularly by means of diffusion holes 206. The diffusion tubes 204 are preferably oriented perpendicular to the central pipe 202 and radiate in a spoke-like fashion. The diffusion tubes 204 are preferably buried beneath or otherwise surrounded by the muffling particles 30 when in use. The surrounding muffling particles 30 act to efficiently dampen sounds and sound waves contained within a stream of exhaust gases from an internal combustion engine, e.g., a diesel engine, and are able to do so while maintaining substantially lower back pressure compared to conventional muffling systems. Although some back pressure is often desirable, reducing the back pressure within the exhaust system will typically increase both fuel efficiency and power.

Several examples of embodiments of the invention are presented in order to demonstrate the practicability and usefulness the invention.

EXAMPLE 1

A reaction chamber similar to the one depicted in FIG. 1 and which included silica sand as the catalytically reactive media was adapted for use with a diesel engine from a conventional tractor trailer. The diesel engine that was utilized for this experiment included a pair of exhaust pipes at the rear of the vehicle. A pair of hoses were attached to the respective pair of exhaust pipes and joined together in a Y union to form a single exhaust conduit leading to the underside of the reaction chamber. A heating/compressor unit was also used in conjunction with the reaction chamber in order to introduce heated air under pressure into the reaction chamber as needed in order to provide a fluidized bed of silica sand heated to a temperature in a range from about 200° C. to about 375° C. In addition, a series of tubes configured and arranged so as to sample untreated exhaust gases as well as treated exhaust gases were interfaced with various analytical devices in order to test the level of waste products in the exhaust gases both before and after treatment by the reaction chamber.

In order to establish a benchmark for how much catalytic oxidation was being carried out by the reaction chamber, untreated exhaust gases were fed through a draw tube and caused to pass through a filter paper for a period of ten minutes in order to trap waste exhaust particulates, i.e. soot. After 10 minutes the filter paper was removed and inspected. A very noticeable buildup of black carbon soot was found on the filter paper.

Thereafter, exhaust gases that were treated by means of the reaction chamber were fed into a draw tube and caused to pass through a filter paper for a period of 10 minutes. Subsequent inspection of the filter paper revealed a remarkable drop in the level of soot that was collected, perhaps up to 95% or more. Whereas the untreated exhaust gases caused a build up of black soot on the filter paper that was easily transferred to a person's fingers, the treated exhaust yielded a faintly gray build up of material that did not easily rub off. Whereas these respective buildups of soot were not quantified a visual inspection showed a drop of at least 75–95% of soot compared to the untreated exhaust.

In addition, the level of carbon monoxide was measured both before and after treatment with the reaction chamber and found to be reduced by about 90%. This indicated that the catalytically reactive media particles were able to catalytically oxidize carbon monoxide to carbon dioxide in a short period of time as the waste exhaust gases rose through the catalytically reactive silica particles.

In addition, the level of nitrogen oxides ($NO_x$) was measured both before and after treatment with the reaction chamber and were also found to be reduced by about 90%. This indicated that the catalytically reactive media particles were able to catalytically eliminate nitrogen oxides in a short period of time as the waste exhaust gases rose through the catalytically reactive silica particles. They were most likely reformed into silicon nitride. Alternatively, they may have been reduced to nitrogen gas as the carbon, carbon monoxide and hydrocarbons were oxidized to carbon dioxide.

This experiment was repeated numerous times and each time there was a noticeable drop in the level of carbon soot, carbon monoxide and nitrogen oxides as a result of passing the waste exhaust gases through the reaction chamber. This demonstrated that the silica particles are catalytically reactive since merely passing a stream of exhaust gases through an inert bed would not be expected to cause further oxidation of any incomplete combustion products found therein. The dramatic increase in the rate and extent of oxidation of the incomplete combustion products strongly indicates the catalytic capabilities of silica sand relative to waste exhaust gases.

Through subsequent experiments it was found that about 100 pounds of silica sand is adequate to catalytically degrade up to 95% of the incomplete combustion products produced by a diesel engine having a displacement of 400 cubic inches. Moreover, it was found that the silica sand did not degrade but could be used almost indefinitely without being depleted. Of course, in the event that the reaction chamber needs to be recharged with silica sand, it can be done so at very low cost. Sand is a very inexpensive commodity compared to conventional catalysts.

EXAMPLE 2

Further experiments were carried out using the apparatus described in Example 1, in which the temperature of the exhaust gases coming out the turbo was measured at 833° F. at a back pressure of 29 inches of water, at full load. This back pressure was caused mostly by the resistance of the diffusion pipe. After passing through the muffling/reaction chamber, the temperature of the waste gases dropped to about 125° F. The waste gases included virtually no measurable soot, hydrocarbons, or CO. The considerable drop in temperature was postulated to be due to the catalytic reactions occurring with the reaction chamber. The sound was greatly muffled and did not exceed 100 db. The inside of the diffusion pipe showed considerable buildup of soot and oily hydrocarbons but was totally clean in the region of the holes adjacent the silica particles.

EXAMPLE 3

Further experiments were carried out using the apparatus described in Example 1, except that the silica sand was not fluidized as much but was kept in only a slightly elevated state. Furthermore, after the diesel engine was warmed up all auxiliary heat was cut off such that the only heat input into the reaction chamber was provided by the diesel engine exhaust. A series of measurements indicated that the temperature leveled off and remained at about 180° C. The treated exhaust gases were sampled and found to be virtually emission free. In particular, the filter paper used to sample particulates from the treated gases remained virtually clean over time (i.e. after sampling for more than 10 minutes), which indicated that over 99% of the particulates were being oxidized without any-additional heat inputs.

Thereafter, large filter paper was placed over the opening of the exhaust stack itself for at least 10 minutes to ensure that the sampling techniques used above were not flawed in some way. The large filter paper was examined and appeared to be virtually clean, which indicated that virtually no particulates were passing through the reaction chamber and into the atmosphere. In short, simply passing waste exhaust gases through a slightly fluidized bed of ordinary silica sand resulted in the virtual elimination of all waste particulates found in diesel engine exhaust. This test confirms that ordinary silica sand can behave as a powerful catalyst in catalytically oxidizing incomplete combustion products of diesel fuel at temperatures as low as about 180° C. without the use of expensive conventional catalysts.

EXAMPLE 4

A reaction chamber containing silica is used to remove up to 98% of the soot and other unburnt carbonaceous materials emitted in the flue gas from an industrial burner that utilizes coal or fuel oil. Carbon monoxide and nitrogen oxides are also greatly reduced. Because the industrial plant is stationary, and because silica is extremely inexpensive, an amount of silica appropriate for oxidizing the unburnt components from the industrial burners is used. The temperature is maintained within a range from about 100° C. to about 500° C. by appropriate means, and the moisture content of the gases within the reaction chamber is maintained by appropriate means, such as by, e.g., a humidifier.

EXAMPLE 5

A reaction chamber containing a fluidized bed of silica was used to catalyze the incomplete combustion products from a 1990 Geo Metro having approximately 125,000 miles. A conventional emission tester was used to determine the hydrocarbon and carbon monoxide levels both before and after passing the exhaust through the inventive reaction chamber. The 1990 Geo Metro was equipped with a factory-installed catalytic converter, which was left in place to determine if the inventive reaction chamber would further remove unburnt gases and particulates produced by a gasoline-powered engine but not catalytically oxidized by the catalytic converter.

Normal levels of hydrocarbons and carbon monoxide were measured by inserting the sampling pipe into the exhaust pipe of the Geo Metro, which is the standard practice. While running at a speed of 2338 RPMs and no load the Geo Metro was tested for emissions. The hydrocarbon level was determined to be 1412 ppm, while the concentration of CO was detected as 0.29%.

Thereafter, the exhaust stream was diverted and passed directly through the reaction chamber. In order to prevent dilution of the exhaust gases all external sources of air flow, such as heated air inputs, were curtailed. Only the exhaust gases from the Geo Metro were introduced into the reaction chamber during the testing procedure. After correcting for dilution, the hydrocarbon level was determined to be only 22 ppm, while the concentration of CO was measured as 0.00%. This means that the reaction chamber of the invention reduced the hydrocarbon level by about 98.5% while removing virtually all of the CO, or over 99% :of the CO. The foregoing test demonstrated that the inventive methods and systems were better able to remove CO and unburnt hydrocarbons more efficiently and completely than standard catalytic converters.

EXAMPLE 6

A reaction chamber containing a fluidized bed of silica was used to catalyze the incomplete combustion products from a 1984 STD Mercedes Benz Diesel. A conventional emission tester was used to determine the hydrocarbon and carbon monoxide levels both before and after passing the exhaust through the inventive reaction chamber. The 1984 STD Mercedes Benz Diesel had no catalytic converter since they are not used with diesel engines due to their ineffectiveness.

Normal levels of hydrocarbons and carbon monoxide were measured by inserting the sampling pipe into the exhaust pipe of the Mercedes Benz Diesel, which is the standard practice. While running at a speed of at least about 2000 RPMs and no load the Mercedes Benz Diesel was tested for emissions. The hydrocarbon level was determined to be 219 ppm, while the concentration of CO was detected as 2.02%.

Thereafter, the exhaust stream was diverted and passed directly through the reaction chamber. In order to prevent dilution of the exhaust gases all external sources of air flow, such as heated air inputs, were curtailed. Only the exhaust gases from the Mercedes Benz Diesel were introduced into the reaction chamber during the testing procedure. After correcting for dilution, the hydrocarbon level was determined to be 0 ppm, while the concentration of CO was measured as 0.01%. This means that the reaction chamber of the invention reduced virtually all of the hydrocarbons, or over 99%, while removing about 99.5% of the CO.

The same catalytic system was used to treat waste exhaust gases from a diesel-powered tractor-trailer rig. The diesel rig was purchased used and was not equipped with a standard muffler. In an effort to speed up testing of the catalytic system, the waste exhaust gases were fed directly into the catalytic degrader. To the surprise of the inventors, the catalytic degrader greatly reduced the noise emitted by the diesel engine. Empirically, the reduction in noise was comparable, or even superior, to the level of noise reduction achieved using conventional mufflers.

In conclusion, the present invention provides improved methods and systems for effectively and inexpensively muffling the sounds emitted by internal combustion engines while substantially reducing back pressure compared to conventional mufflers.

The invention further provides methods and systems for muffling the sound emitted by internal combustion engines which are simultaneously capable of substantially reducing back pressure compared to conventional mufflers while meeting or exceeding present noise reductions standards.

Moreover, such methods and systems for muffling the sound emitted by internal combustion engines are capable of reducing back pressure so as to improve fuel efficiency and increase engine power, while also providing equal or greater muffling of engine sounds compared to conventional mufflers.

In addition, such methods and systems for muffling the sound emitted by internal combustion engines are adaptable so as to also be capable of reducing pollutants found in exhaust emissions such that they provide the dual purpose of reducing engine noise and engine pollution.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for muffling the sounds of an internal combustion engine comprising:

a muffling chamber;

a volume of muffling particles disposed within the muffling chamber; and an exhaust conduit disposed at least partially within the muffling chamber, adjacent a portion of the muffling particles, and communicating between an internal combustion engine and the muffling chamber so that waste exhaust gases produced by the internal combustion engine are passed into the muffling chamber and through at least a portion of the volume of muffling particles in order to muffle engine sounds propagated by the waste exhaust gases, the exhaust conduit including a central pipe having an end disposed within the muffling chamber and a plurality of diffusion tubes connected to and in gaseous communication with the end of the central pipe, each diffusion tube including at least one diffusion hole through which the waste exhaust gases will pass.

2. A system for muffling the sounds of an internal combustion engine as defined in claim 1, wherein the internal combustion engine is a diesel engine and wherein the engine sounds emitted after being muffled by the muffling particles have a volume less than about 100 db.

3. A system for muffling the sounds of an internal combustion engine as defined in claim 1, wherein the muffling system results in exhaust system back pressure in a range of about 3 to about 5 inches of water when the diesel engine is running at idle speed.

4. A system for muffling the sounds of an internal combustion engine as defined in claim 1, wherein the muffling system results in exhaust system back pressure in a range of about 15 to about 30 inches of water when the diesel engine is running at a rate of 2800 RPMs.

5. A system for muffling the sounds of an internal combustion engine as defined in claim 1, wherein the muffling particles consist essentially of silica, alumina, or a mixture thereof, and wherein the muffling particles also catalytically degrade pollutants found within the waste exhaust gases.

6. A system for muffling the sounds of an internal combustion engine as defined in claim 5, wherein the measured level of carbon dioxide within the waste exhaust gases decreases as a result of passing through the muffling chamber.

7. A system for muffling the sounds of an internal combustion engine as defined in claim 1, wherein the plurality of diffusion tubes radiate outwardly in a spoke-like fashion from the end of the central pipe and wherein each diffusion tube includes a plurality of diffusion holes.

8. A system for muffling the sounds of an internal combustion engine as defined in claim 7, wherein the plurality of diffusion tubes are submerged within a volume of the muffling particles.

9. A system for muffling the sounds of an internal combustion engine as defined in claim 7, wherein the plurality of diffusion tubes are disposed orthogonally with respect to the central pipe and are spaced apart equidistant from each other.

10. A system for muffling the sounds of an internal combustion engine as defined in claim 1, wherein the exhaust gases have a temperature of less than about 275° F. within the interior of the muffling chamber.

11. A muffling system for use in combination with a diesel engine comprising:

a muffling chamber;

a volume of muffling particles disposed within the muffling chamber, the volume of muffling particles having a lower end and an upper end; and a plurality of diffusion tubes, in gaseous communication with the diesel engine, buried beneath or surrounded by the muffling particles, each of said diffusion tubes including at least one opening adjacent a portion of the muffling particles so that waste exhaust gases produced by the internal combustion engine are passed into the muffling chamber and through at least a portion of the volume of muffling particles in order to muffle engine sounds generated by the diesel engine and propagated by the waste exhaust gases, the waste exhaust gases passing through and exiting the upper end of the volume of muffling particles, wherein at least a portion of the muffling particles are suspended by the waste exhaust gases as the waste exhaust gases pass through the muffling particles when the diesel engine is operating under a load in order to reduce back pressure.

12. A muffing system as defined in claim 11, wherein the muffing system results in exhaust system back pressure in a range of about 15 to about 30 inches of water when the diesel engine is running at a rate of 2800 RPMs.

13. A muffing system as defined in claim 11, wherein the muffing particles consist essentially of silica, alumina, or a mixture thereof, wherein the muffling particles also catalytically degrade pollutants found within the waste exhaust gases.

14. A muffling system as defined in claim 11, wherein the plurality of diffusion tubes are connected to and in gaseous communication with an end of a central pipe.

15. A muffling system as defined in claim 14, wherein the plurality of diffusion tubes radiate outwardly in a spoke-like fashion from the end of the central pipe and wherein each diffusion tube includes a plurality of diffusion holes.

16. A muffing system as defined in claim 15, wherein the plurality of diffusion tubes are submerged within the volume of muffing particles.

17. A muffling system as defined in claim 15, wherein the plurality of diffusion tubes are disposed orthogonally with respect to the central pipe and are spaced apart equidistant from each other.

* * * * *

UNITED STATES PATENT AND TRADEMARK OFFICE

CERTIFICATE OF CORRECTION

PATENT NO. : 6,457,552 B2
DATED : October 1, 2002
INVENTOR(S) : Thomas C. Maganas and Alan L. Harrington It is certified that error appears in the above-identified patent and that said Letters Patent is hereby corrected as shown below:

Column 2,
Line 14, change “an” to -- a --

Column 3,
Line 21, change “explained:” to -- explained --
Line 32, change “0.0.1” to -- 0.01 --

Column 5,
Line 7, change “may:” to -- may --

Column 7,
Line 13, change “compared:” to -- compared --

Column 10,
Line 30, change “or” to -- of --

Column 11,
Line 26, change “fluidized:” to -- fluidized --

Column 16,
Line 20, change “:of” to -- of --

Column 17,
Line 20, change “illustrated” to -- illustrative --

Signed and Sealed this

Eleventh Day of March, 2003

JAMES E. ROGAN
*Director of the United States Patent and Trademark Office*